United States Patent [19]

Statsenko et al.

[11] 4,138,323

[45] Feb. 6, 1979

[54] APPARATUS FOR ANODIC PROTECTION AGAINST CORROSION OF METAL OBJECTS IN CONTACT WITH ELECTRICALLY CONDUCTIVE MEDIA

[76] Inventors: Nikolai N. Statsenko, Gvardeisky prospekt, 59b, kv. 91; Vladislav S. Kuzub, ulitsa Lenina, 57, kv. 22; Vladimir G. Moisa, ulitsa Gagarina, 14 b, kv. 53; Evgeny A. Kryzhny, ulitsa Gagarina, 54 b, kv. 47, all of Severodonetsk Voroshilovgradskoi oblasti, U.S.S.R.

[21] Appl. No.: 727,844

[22] Filed: Sep. 29, 1976

[51] Int. Cl.[2] ..... C23F 13/00

[52] U.S. Cl. ..... 204/196; 204/147

[58] Field of Search ..... 204/147, 196

[56] References Cited

U.S. PATENT DOCUMENTS

| | | | |
|---|---|---|---|
| 2,050,367 | 8/1936 | Myhre | 204/228 |
| 2,918,420 | 12/1959 | Sabins | 204/196 |
| 3,197,755 | 7/1965 | Conger | 204/196 |
| 3,346,471 | 10/1967 | Foroulis | 204/147 |
| 3,371,023 | 2/1968 | Banks et al. | 204/196 |
| 3,483,101 | 12/1969 | Delahunt et al. | 204/196 |
| 3,841,988 | 10/1974 | Gleason | 204/196 |

*Primary Examiner*—T. Tung

*Attorney, Agent, or Firm*—Lackenbach, Lilling & Siegel

[57] ABSTRACT

The apparatus comprises self-contained potentiostatic devices, for control of the potential of objects, electrically connected via a controlled change-over switch to reference (standard) electrodes, auxiliary electrodes and cathodes in contact with an electrically conductive media in said object. The apparatus includes a stand-by power source connected through the change-over switch to the objects. Connected to the change-over switch control circuit is a means for the potential of the object.

The potcntiostatic devices form, together with the reference and auxiliary electrodes and the objects, independent control circuits.

When the potential of one of the objects deviates from the preset value, the means for sensing the potential generates a signal for the change-over switch to connect the stand-by power source to this object.

4 Claims, 2 Drawing Figures

APPARATUS FOR ANODIC PROTECTION AGAINST CORROSION OF METAL OBJECTS IN CONTACT WITH ELECTRICALLY CONDUCTIVE MEDIA

The present invention relates to the protection of metals against corrosion, and more particularly to apparatus for anodic protection of various industrial structures against corrosion, the structures being in contact with aggressive electrically-conductive media and made of materials prone to passivation in these media.

The invention is best suitable for corrosion protection of structures in chemical, food, textile and pulp-and-paper industries.

Known in the art are various methods and systems for corrosion protection of industrial structures. The method of corrosion control by anodic polarization, however, is considered to be most effective in a number of cases.

Essentially, this method is as follows.

It is well known that when a metal gets into contact with an aggressive medium, it is attacked by corrosion, a potential, known as stationary, being established on the metal's surface. If the metal potential shifts towards positive values, the rate of corrosion, at definite values and in a number of cases, will sharply decrease. This phenomenon is commonly known as the passivity of metal, and the shifting of its potential towards the range of the indicated values is known as passivation. The range of the potential values wherein the passivity takes place is known as the passive region. The absolute value and extent of this region depend upon the nature of the corroding metal and the aggressive medium to which the metal is exposed. Consequently, by shifting the metal potential towards the passive region, it is possible to protect it against corrosion. This is normally attained either by passing electric current, known as polarizing, from an external power source between the metal to be protected, serving as the anode in this case, and and auxiliary electrode serving as the cathode, or else by adding various components, such as passivators, into the corrosive medium. The passivity of metal attained by applying the polarizing current is what, in essence, constitutes the anoidc corrosion protection method, and the process of passivation is, in this case, referred to as the anodic polarization of metal.

The industrial application of this method requires apparatus for maintaining the potential of the objects to be protected within the passive region, which apparatus are to fall in line with certain specific requirements, the most important one being their high degree of reliability in maintaining the potential of the objects in question within a predetermined range.

This type of apparatus will ordinarily comprise devices for controlling the polarizing current with respect to the potential of the objects being protected, namely, potentiostatic devices, as well as auxiliary electrodes serving as cathodes and reference (standard) electrodes being in contact with the corrosive medium and connected to the potentiostatic devices.

Known in the art is an apparatus for anodic protection of vessels against corrosion (cf. U.S. Pat. No. 3,197,755). According to this patent, the apparatus comprises an auxiliary electrode and two reference electrodes placed in the aggressive medium, and a controller connected to the auxiliary and reference electrodes as well as to the vessels being protected. The apparatus also includes a device for comparing the potential difference of the reference electrodes, which is connected to these electrodes as well as to a change-over switch, the latter also being connected to the controller. When one of the vessel potentials deviates from a predetermined range, the controller adjusts the polarizing current so that the vessel potential remains within the predetermined range. In case of failure of one of the reference electrodes, the device for comparing the potential difference of the electrodes sends an alarm signal to the operator and actuates the switching device. The latter switches over the controller to the properly functioning reference electrode.

The apparatus described above maintains its efficiency only when one of its elements, the reference electrode, in this case, is out of order. If, however, any other element or unit gets out of order (exept the reference electrode), the apparatus will fail to maintain the potential of the vessel being protected within the predetermined range, thus failing to meet the most important requirement imposed on structures of this type, namely, a high degree of reliability. Besides, the apparatus is unable to provide corrosion protection for a plurality of industrial vessels.

There is also known an apparatus for anodically protecting several vessels against corrosion, wherein but one potentiostat is used (cf. U.S. Pat. No. 3,483,101; Cl. 204–147). This apparatus comprises one auxiliary electrode and one reference electrode arranged in each vessel to be protected and connected through a cam timing switch to the potentiostat.

To maintain the potential of the vessels being protected within a predetermined range, the potentiostat, by using the action of the cam timing switch, is electrically connected in a stepwise manner to each vessel for equal time periods. When a potential shift occurs at any one of the vessels, the potentiostat initiates polarizing current to this vessel, the "on" cycle of which lasts long enough to maintain the vessel potential within the preset range. The switching "on-off" cycles of the cam timing switch are preset in accordance with specific features of the vessels being protected and remain within the range of from one to ten minutes per vessel, remaining constant during the whole operating period. The failure of one of the apparatus units or elements will impair the desired efficiency of protection of the vessels connected thereto.

It should also be pointed out that after being in operation for a certain period of time, an apparatus for anodic protection may require repair, preventive inspection or replacement of elements (e.g. potentiostats, reference electrodes, etc.). The prior art systems cannot be repaired or maintained without the potential of the vessels deviating from the preset range, which limits the scope of their application.

Besides, the known systems fail to maintain the potential of the vessels being protected within a predetermined range in case of disturbances occuring during operation of these vessels, for example, the concentration of the corrosive medium is increased, or one of the apparatus elements, for instance, the potentiostat, is out of order.

It should be noted that the anodic polarization corrosion protection method fails to find wide industrial application because heavy polarizing currents are required to convert the metal of the objects being protected to the passive state, or because passivating agents should be added to the corrosive medium.

The use of heavy polarizing currents requires complex powerful sources which are not included in the standard set of such an apparatus. The addition of passivating agents to the corrosive medium is oftentimes not permitted by the production process.

It should also be noted that when a production system is being put into operation, the restrictions mentioned above could be ignored with no damage to the production process. However, with the systems already in operation, these restrictions assume primary importance, imposes rather strict requirements upon an apparatus for anodic protection of objects against corrosion, and demand a high degree of reliability in maintaining the vessel potential within a preset range.

Ordinarily, operation lines may include a plurality of either similar or dissimilar structures in need of protection against corrosion.

Therefore, it is preferable that the apparatus for anodic protection should be designed so as to provide for simultaneous protection of several structures electrically connected thereto, functioning either in one or several operation lines.

Accordingly, it is the primary object of the present invention to provide an apparatus for anodic protection of industrial structures against corrosion, wherein a high degree of reliability in maintaining the structure potential within a preset range is ensured notwithstanding disturbances in the operating conditions of these structures, or a break-down of the apparatus units or elements.

Another object of the invention is to afford corrosion protection to a plurality of either similar or dissimilar industrial structures, as well as to complete operation lines.

A further object of the invention is to increase the number of industrial structures connected to the apparatus in the course of operation without interrupting the production process, to and carry out repair and maintenance of all the apparatus units with no loss in the efficiency of the structures' protection.

Finally, it is an object of the invention to provide an apparatus for employment in various branches of industry.

Essentially, the proposed invention is an apparatus for anodic protection of structures, wherein the structure potential control circuits and comparator circuits are made independent.

These and other objects are attained in an apparatus for anodic protection of metal objects against corrosion, the object being in contact with an electrically conductive media, wherein the apparatus comprises self-contained potentiostats connected to a reference (standard) electrode and auxiliary electrodes serving as cathodes, which are in contact with the electrically conductive media, the indicated elements forming independent potential control circuits. In in accordance with the invention, there is provided a stand-by power source, with a capacity exceedingly higher than that of any of the self-contained potentiostats, and a controlled change-over switch connecting the self-contained potentiostats and stand-by power source to the objects being protected. There is also provided a means for sensing the potential connected to the control circuit of the controlled change-over switch and generating a signal for the change-over switch to electrically connect the stand-by power source to the object having its potential deviate from the preset value.

The provision of self-contained potentiostats for each object being protected makes it possible to maintain the potential difference at, and carry out polarization of, each object separately and independently of one another with respect to their specific features.

The stand-by power source of the apparatus, whose capacity is two to three times higher than that of each self-contained potentiostat, and the controlled change-over switch, which electrically connects the potentiostats and the stand-by power source to the objects being protected, make possible the switch over of each object being protected to the current of the stand-by power source, thereby providing for repair and preventive inspection of the potentiostats, reference electrodes and stand-by power source with no loss in the efficiency of the objects' protection.

The means for sensing the object potential, which generates a signal for the change-over switch to connect the stand-by power source to the object being protected having its potential deviate from the preset value, provides for a high degree of reliability in maintaining the potential of the objects being protected notwithstanding a break-down of one of the potentiostatic devices, or disturbances occurring in the performance characteristics of these objects.

In accordance with one of the possible embodiments of the invention, the means for sensing the objects' potential comprises a potential comparing device provided with additional reference (standard) electrodes, each being in contact with the electrically conductive medium and connected via an interrogating device to a potential measuring device having one of its outputs electrically connected via a logical AND-gate to the controlled change-over switch intended to apply the stand-by power source current to the object having its potential deviate from the preset value.

Such an embodiment of the means for sensing the object potential ensures a high degree of reliability in maintaining the potential of the objects being protected within a predetermined range, both in case of failure of the reference electrodes or disturbances in the performance characteristics of the industrial objects. The continuous control of all the object potentials effected by the interrogating device and independent potential control circuits make the apparatus for corrosion protection applicable in systems having a plurality of similar and dissimilar industrial objects. The number of objects is determined mainly by the number of positions of the interrogating device used.

The employment of a self-contained stand-by power source (e.g. storage battery) ensures a high degree of reliability in maintaining the object potential within the preset range even in case of an emergency power supply cut-off, this being an important factor under conditions of unstable power supply. The capacity of the stand-by power source should be sufficient to enable simultaneous maintenance of the potential of all the objects being protected.

Since the potentiostatic devices, as well as the potential sensing means can be preset at various potential values, depending upon specific conditions, the herein disclosed apparatus can advantageously be used in various fields of industry to afford corrosion protection to structures already in operation as well as those to be introduced. The apparatus may also be used for the protection of complete production lines.

Other objects and advantages of the present invention will be better understood from the following detailed description of an embodiment thereof taken in conjunction with the accompanying drawings, wherein.

Figure 1:
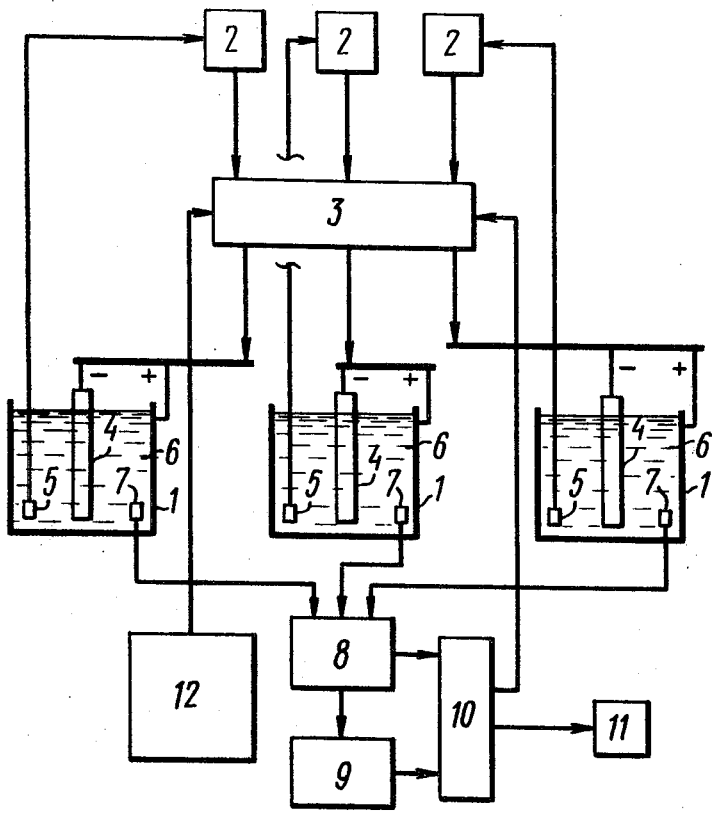
FIG. 1 is a block diagram of an apparatus in accordance with the invention.

The proposed apparatus for anodic protection of objects against corrosion comprises potentiostats 2, which are equal in number to the objects 1 and have their positive terminals connected through a controlled change-over switch 3 to the objects 1 and their negative terminals connected to auxiliary electrodes 4 serving as cathodes and accommodated in each object 1. (As shown in FIG. 1, the leads for the positive and negative poles are contained in a single heavy duty wire, such as a coaxial cable.)

Each potentiostat 2 has its input connected to a reference electrode 5 positioned in each object 1. The cathodes 4 and electrodes 5 are in contact with an electrically conductive medium 6 inside the objects 1.

Thus, the potentiostats 2, cathodes 4 and objects 1, as well as the reference electrodes 5, form independent potential control circuits monitoring the potential of the objects 1 to be protected.

There is arranged in each object 1 an additional electrode 7 connected via an interrogating device 8 to a device 9 intended for measuring the potential of the objects 1. The potential measuring device 9 is connected to one of the inputs of a logical AND-gate 10, which has its second input connected to the interrogating device 8 and its outputs connected to the change-over switch 3 and to a means 11 for sending a signal indicative of deviation of the potential at the objects 1 from the preset value.

The apparatus also comprises a stand-by power source 12 connected through the change-over switch 3 to the objects 1. The capacity of this power source is exceedingly higher than that of a power source (not shown) of each self-contained potentiostat 2 and is determined by specific conditions. Ordinarily, the capacity is regarded sufficient if it can maintain the potential of at least half of the objects electrically connected to the apparatus.

Thus, the means for sensing the potential of the objects, 1, which comprises the potential measuring device 9, additional reference electrode 7, interrogating device 8 and logical AND-gate 10, is made independent from the potential control circuits described above.

The proposed apparatus operates as follows.

The potential at each object 1 is adjusted independently by means of a respective potentiostat 2 and monitored by the potential measuring device 9 with the help of the additional reference electrodes 7 electrically connected to and disconnected from the potential measuring device 9 at regular intervals by the interrogating device 8. A lead 24 is used to connect the measuring device 9 to the object 1. Thus, when any given object is being checked, a complete circuit for that object is formed, namely, the object 1, the lead 24, the measuring device 9, the interrogating device 8, and the reference electrode 7.

In case the potential at any one of the objects 1 deviates from the preset value, which may occur due to disturbances in operating conditions or failure of one of the units, e.g. potentiostat, 2, the potential measuring device 9 generates a signal applied to the AND-gate 10. The latter on obtaining information from the interrogating device 8 as to which particular object 1 has its potential monitored at that moment actuates the change-over switch 3.

The change-over switch 3 electrically disconnects the respective potentiostat 2 from the object 1, switching it over to the stand-by power source 12. Simultaneously, the AND-gate 10 actuates the device 11, thus generating a signal indicative of the potential at the respective object deviating from the preset value, thus informing the operator of the disturbance. With the failure having been eliminated, the device 11 is switched off.

Figure 2:
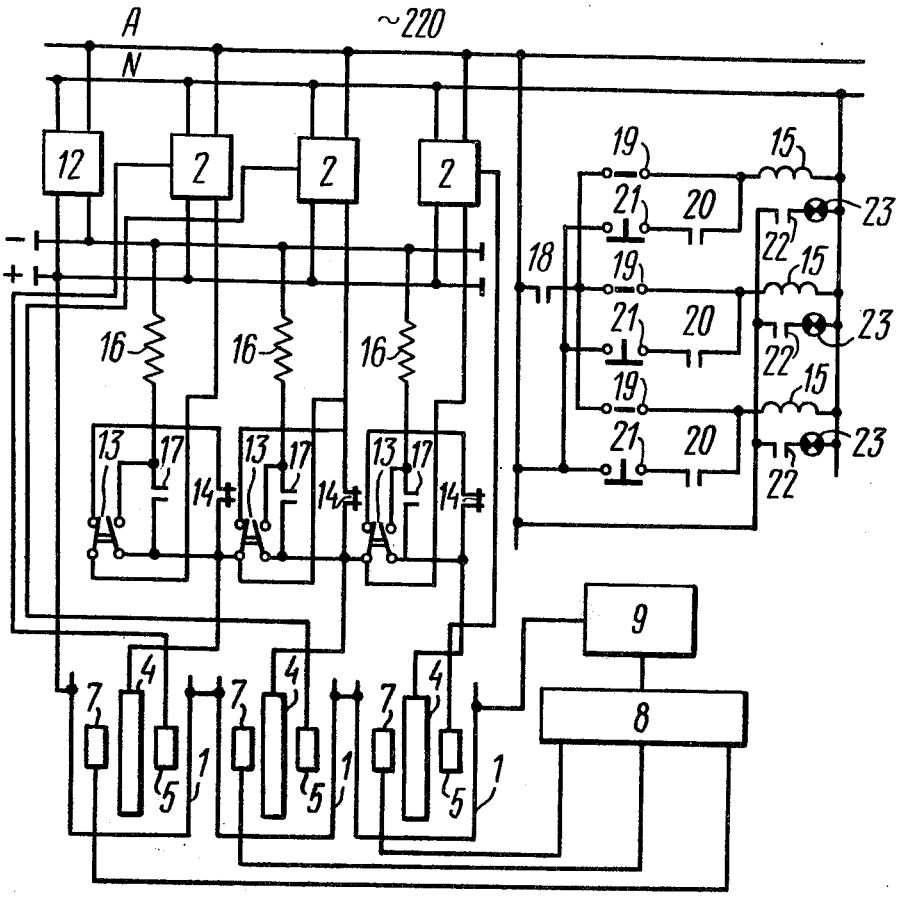
FIG. 2 is a schematic, electrical diagram of one of the possible embodiments of the invention.

One of the possible embodiments of the invention is shown in FIG. 2. Elements similar to those shown in FIG. 1 retain the same reference numerals in FIG. 2.

In accordance with the invention, the potentiostats 2 have their positive terminals (not shown) connected to the objects 1 being protected and their negative terminals being connected, across the opening contacts of switches 13 and opening contacts 14 of an electromagnetic relay 15 to respective cathodes 4.

The stand-by power source 12 has its positive terminal connected to the objects 1 being protected and its negative terminal connected, via ballast resistors 16 and closing contacts 17 of the relay 15, to the cathodes 4.

The closing contacts 17 of the relay 15 are shunted by the closing contacts of the above-mentioned switches 13. The reference electrodes 5 are directly connected to the respective potentiostats 2, and the electrodes 7 are connected via the interrogating device 8 to the potential measuring device 9. An automatic multiple-point potentiometer is used in the embodiment under consideration to perform the function of the potential measuring device 9. The function of the interrogating device 8 is performed by the position selector of the said potentiometer. The AND-gate (shown in FIG. 1 under reference number 10) is made up, in this embodiment, by a closing emergency contact 18 of said potentiometer, contacts 19 of the position selector switch of the same potentiometer, and by the electromagnetic relay 15. The contacts 19 of the position selector are connected to the relay 15. The circuits of the contacts 19 of the position selector are shunted by series-connected contacts 20 of the relay 15 and by circuit opening buttons 21, and are associated through these elements to phase A of the supply voltage. Closing contacts 22 of the relay 15 are connected to respective signal lamps 23 of the device 11.

The potential of the objects being protected is maintained by means of the potentiostats 2. Therewith, the contacts of all the relays and switches are positioned as shown in FIG. 2.

When the potential at one of the structures deviates from a preset value, the emergency contact 18 of the above potentiometer is closed. A respective contact 19 of the potentiometer's position selector is closed, too.

The relay 15, corresponding to the object 1 having its potential deviated from the preset value, operates on being energized via the contacts 18 and 19 and, by its contact 14, switches off the respective potentiostat 2, thus disconnecting it from the respective cathode 4, and, by its contact 17, switches on the stand-by power source 12, thus electrically connecting it through the ballast resistor 16 intended for limiting the polarizing current to the cathode 4.

At the same time, the contact 22 switches on the respective signal lamp 23. The contact 20 is used to actuate a respective relay 15, connecting it through the button 21 to the supply voltage. This makes it possible to keep the relay 15 in the on position even after opening the contact 19, this being due to the fact that the position selector of the potentiometer has been shifted to the following position.

After detecting and eliminating the fault, the operator, by pushing the respective button, breaks the supply circuit of the relay 15. The contacts are switched over in a reverse sequence, whereby the apparatus is brought back to the initial state.

Whenever there is a necessity to carry out repair or preventive inspection, one of the switches 13 is turned on disconnecting the respective object 1 being protected from the respective potentiostat 2, switching over this object to the stand-by power source 12.

To bring the apparatus back to the initial state, it is sufficient to turn the switch 13 back to its previous position. This being done, the respective object 1 is electrically disconnected from the stand-by power source 12 and connected back to the respective potentiostat 2.

It should be pointed out that the herein disclosed apparatus may be used for maintaining the potential of the structures being protected at a preset value in the case of their cathodic protection. This will only require reversing the polarity of connection of the potentiostat and stand-by power source to the object being protected, serving as the cathode in this case, and to the auxiliary electrode, serving as the anode.

What is claimed is:

1. An apparatus for anodic protection of metal objects in contact with electrically conductive media, comprising self-contained potentiostats for control of the potential of each of said metal objects, there being one potentiostat for each metal object, a positive terminal of each of said potentiostats being connected to the respective metal object; a controlled change-over switch electrically connecting said potentiostats to said metal objects; an auxiliary electrode, which is in contact with said electrically conductive medium and connected to a negative terminal of the respective potentiostat, for each metal object, said auxiliary electrodes serving as cathodes and said metal objects serving as anodes; a reference electrode which is in contact with said electrically conductive medium for each metal object, said reference electrode being connected to an input of the respective potentiostat, said potentiostats, reference electrodes and auxiliary electrodes defining independent circuits controlling the potential of said metal objects; a stand-by power source electrically connected via said change-over switch to said metal objects, the capacity of said power source being higher than that of each of said potentiostats; a means independent of said circuits controlling the potential of said metal objects for sensing the potential of said metal objects connected to a control circuit of said change-over switch and generating a control signal for said change-over switch to electrically connect said stand-by power source to a metal object when its potential deviates from a preset value and to disconnect the respective potentiostat.

2. An apparatus as claimed in claim 1, wherein the means for sensing the potential of the metal objects comprises a device for measuring the potential of the metal objects, said device being provided with an additional reference electrode, which is in contact with the electrically conductive medium and connected via an interrogating device to the potential measuring device, for each metal object, said potential measuring device having an output connected via a logical AND-gate to the controlled change-over switch to switch over the stand-by power source to the metal object whose potential is deviating from the preset value.

3. An apparatus as claimed in claim 2, further comprising a means for indicating a deviation from the preset value of the potential of the metal object electrically connected to an output of the logical AND-gate.

4. An apparatus as claimed in claim 1, wherein the stand-by power source is a storage battery.

* * * * *